US011727909B1

(12) United States Patent
Mathur

(10) Patent No.: US 11,727,909 B1
(45) Date of Patent: Aug. 15, 2023

(54) META MATERIAL POROUS/PORO-ELASTIC SOUND ABSORBERS

(71) Applicant: ACOUSTIC METAMATERIALS LLC, Scarsdale, NY (US)

(72) Inventor: Gopal Prasad Mathur, Trabuco Canyon, CA (US)

(73) Assignee: ACOUSTIC METAMATERIALS LLC, Scarsdale, NY (US)

( * ) Notice: Subject to any disclaimer, the term of this patent is extended or adjusted under 35 U.S.C. 154(b) by 0 days.

(21) Appl. No.: 18/088,667

(22) Filed: Dec. 26, 2022

Related U.S. Application Data

(60) Provisional application No. 63/362,138, filed on Mar. 30, 2022.

(51) Int. Cl.
*G10K 11/162* (2006.01)
*G10K 11/02* (2006.01)

(52) U.S. Cl.
CPC ..... *G10K 11/162* (2013.01); *G10K 11/02* (2013.01)

(58) Field of Classification Search
CPC ..... G10K 11/162; G10K 11/02
See application file for complete search history.

(56) References Cited

U.S. PATENT DOCUMENTS 10,501,867 B2 * 12/2019 Ayon ..... C30B 23/08
11,381,905 B2 * 7/2022 Mathur ..... H04R 1/025
11,514,878 B2 * 11/2022 Semperlotti ..... G10K 11/172
11,562,728 B2 * 1/2023 Lee ..... G10K 11/172
2012/0061176 A1 * 3/2012 Tanielian ..... G10K 11/162 181/207
2014/0339014 A1 * 11/2014 Varanasi ..... G10K 11/168 181/292
2016/0027427 A1 * 1/2016 Yang ..... G10K 11/172 181/286
2017/0316772 A1 * 11/2017 Park ..... G10K 11/172
2018/0359558 A1 * 12/2018 Mathur ..... H04R 1/2857
2021/0097967 A1 * 4/2021 Logan ..... G10K 11/30

FOREIGN PATENT DOCUMENTS

WO WO-2020128103 A1 * 6/2020 ..... G10K 11/165

* cited by examiner

*Primary Examiner* — Forrest M Phillips
(74) *Attorney, Agent, or Firm* — Michael J. Feigin, Esq.; Feigin and Fridman LLC

(57) ABSTRACT

An acoustic metamaterial (AMM) passive impedance matching technique to enhance the acoustic performance of porous/poro-elastic sound absorbing materials is disclosed. An AMM passive matching device is implemented by achieving negative refractive index with double negative parameters, i.e., negative effective mass density and effective bulk modulus scheme, using various acoustic elements. The AMM technique consists of meta material architecture of acoustic inductive open tubes positioned strategically around the outside surfaces of the porous media and perforated screens inserted inside porous media to generate complex acoustic impedance load of the porous media; the inductance defined by a predetermined lengths of the open tubes. The device includes open tubes extending from the porous media to the outside ambient medium generating the desired reactive load over the broadband frequency region of the complex acoustic impedance of the porous media. The AMM open tubes and the resistive perforated screens generate conjugate acoustic impedance that matches the complex acoustic impedance.

10 Claims, 10 Drawing Sheets

META MATERIAL POROUS/PORO-ELASTIC SOUND ABSORBERS

CROSS-REFERENCE TO RELATED APPLICATIONS

This application claims the benefit of priority of U.S. Provisional Patent Application No. 63/362,138, filed on Mar. 30, 2022, the contents of which are relied upon and incorporated herein by reference in their entirety. The entire disclosure of any publication or patent document mentioned herein is entirely incorporated by reference.

FIELD OF THE DISCLOSED TECHNOLOGY

The disclosed technology relates generally to passive porous and/or poro-elastic sound absorbing materials with meta material devices integrated within for efficient sound absorption. More specifically, the disclosed technology is related to enhancing sound absorption of porous/poro-elastic materials over a wider broadband frequency range by incorporating passive impedance matching developed using an acoustic meta material approach.

BACKGROUND OF THE DISCLOSED TECHNOLOGY

Traditionally, porous, poro-elastic, and fibrous materials have been the most widely used sound-absorbing materials due to their excellent absorption performance in a broad range of audible frequencies and their relative low manufacturing cost and low weight.

Porous and poro-elastic foams can have open or closed cell structures. With open cell structures the pores are interconnected and significant acoustic absorption can result. Closed cell structures, on the other hand, do not permit the passage of sound and so the absorption is rather low. Consequently, it is important to check that acoustic foam is used where absorption is needed. It is possible, however, to perforate closed foam structures at the end of manufacture and so provide moderate absorption by interconnecting the pores.

Porous/poro-elastic absorbers, typically open cell foams or melamine foams, absorb noise by friction within the cell structure. Porous open cell foams are highly effective noise absorbers across a broad range of medium-high frequencies. Performance can be less impressive at lower frequencies.

Typical porous absorbers are carpets, acoustic tiles, acoustic (open cell) foams, curtains, cushions, cotton and mineral wool. They are materials where sound propagation occurs in a network of interconnected pores in such a way that viscous and thermal effects cause acoustic energy to be dissipated. As the porous absorber thickness increases, the absorption at low frequency usually increases. For the porous absorber to create significant absorption, it needs to be placed somewhere where the particle velocity is high.

In general, passive noise control methods that use sound-absorbing porous/poro-elastic materials are most effective at mid to high frequencies. Acoustical porous materials are extensively used in many noise control applications such as, automotive, aircraft, appliance, HVAC, and other industries; as they can be used to absorb airborne sound (e.g., automotive interior headliners) or to enhance the transmission loss of barrier systems (e.g., aircraft fuselage or automotive dash panel applications). The basic acoustical characteristic of all porous/poro-elastic materials, is a cellular network of interlocking pores. Incident sound energy is converted into heat energy within these pores. Cellular materials with closed and non-interlocking cells such as foamed resins, cellular rubbers, foam glass, etc. are poor sound absorbers.

The absorption of sound results from the dissipation of acoustic energy to heat. Many authors have explained this dissipation mechanism in the past. When sound enters porous materials, owing to sound pressure, air molecules oscillate in the interstices of the porous material with the frequency of the exciting sound wave. This oscillation results in frictional losses. A change in the flow direction of sound waves, together with expansion and contraction phenomenon of flow through irregular pores, results in a loss of momentum.

Due to excitation of sound, air molecules in the pores undergo periodic compression and relaxation. This results in change of temperature. Because of long time lag, large surface to volume ratios and high heat conductivity of cell walls, heat exchange takes place isothermally at low frequencies. At the same time in the high frequency region compression takes place adiabatically. In the frequency region between these isothermal and adiabatic compression, the heat exchange results in loss of sound energy. This loss is high in fibrous materials if the sound propagates parallel to the plane of cell walls and may account up to 40% sound attenuation. So, altogether the reasons for the acoustic energy loss when sound passes through sound absorbing materials are due to: (i) Frictional losses, (ii) Momentum losses, (iii) Temperature fluctuations.

Sound absorption of porous/poro-elastic foams is more efficient at higher frequencies than at low frequencies. Their acoustical efficiency improves in the low frequency range with increased thickness and with distance from their solid backing. Porous sound absorption materials are composed of channels, cracks or cavities, which allow the sound waves entering the materials. Sound energy is dissipated by thermal loss caused by the friction of air molecules with the pore walls, and viscous loss bring by the viscously of airflow within the materials.

The sound absorption performance of porous/poro-elastic materials is commonly characterized by the sound absorption coefficient (SAC). The SAC of such materials can be experimentally evaluated using the impedance tube or be predicted using acoustic transfer analysis method along with experimental measurements.

Porous/poro-elastic materials (PM) show good sound absorption performance, however, the sound absorbing property of PMs with different parameters are greatly different. PM is composed of solid phase (skeleton) and liquid phase (usually air), and the liquid phase fills these skeletons to form an inter-connective sound absorbent of PM. Common porous acoustic models include empirical models and equivalent fluid models. There are two main models for porous materials to predict their SAC in previous studies: the empirical model represented by Delany-Bazley (DB) model and the phenomenological model represented by Johnson-Champoux-Allard (JCA) model.

The empirical model only needs to measure the airflow resistivity and then establish respectively the power law relations between the characteristic impedance and the airflow resistivity, and the relations between the propagation constant and the airflow resistivity by fitting a large number of measurements. It is obvious that the empirical models are easy to implement. However, the empirical model does not consider the microstructure of the pores, and moreover, each empirical model is usually best suitable for certain type of materials and certain frequency ranges.

The phenomenological model takes the influence of micro-factors on the acoustical properties of the materials into account. They consider the frame of a porous material as rigid and involve five non-acoustical parameters for the surface impedance calculation, namely porosity, tortuosity, airflow resistivity, viscous and thermal characteristic lengths. The phenomenological model establishes a relationship between the microstructure and the acoustic performance through characterizing porous materials with equivalent fluid, which makes them have higher prediction accuracy. The JCA model is now the most widely phenomenon model used in predicting the SAC of porous materials.

Referring to FIG. 1A, FIG. 1B, FIG. 1C, and FIG. 1D, simultaneously, FIG. 1A shows a sound absorbing material comprising a fiberglass blanket according to one embodiment of the present disclosed technology. FIG. 1B shows the fiberglass blanket of FIG. 1A on a microscopic scale according to one embodiment of the present disclosed technology. FIG. 1C shows a sound absorbing material comprising a melamine foam according to one embodiment of the present disclosed technology. FIG. 1D shows the melamine foam of FIG. 1C on a microscopic scale according to one embodiment of the present disclosed technology. Light-weight, fibrous materials (e.g., fiberglass, rockwool, etc.) and reticulated foams (e.g., polyurethane and melamine open cell foams) are the simplest case of porous media for which the values of porosity and tortuosity are very close to unity and their pore size is relatively constant.

As the porous absorber thickness increases, the absorption at low frequency usually increases. For the porous absorber to create significant absorption, it needs to be placed somewhere where the particle velocity is high. The particle velocity close to a room boundary is usually small, and so the parts of the absorbent close to the boundary are not generating much absorption. It is the parts of the absorbent furthest from the backing surface which are often most effective, and this is why thick layers of absorbent are needed to absorb low frequencies. For low frequencies, where the wavelength is large, one has to go a considerable distance from the wall to reach a point where the particle velocity is significant. The absorbent needs to be at least a tenth of a wavelength thick to cause significant absorption, and a quarter of a wavelength to absorb all the incident sound.

Sound absorption coefficient of porous/poro-elastic foam can be predicted accurately using numerical models as stated above. The sound absorption coefficient (SAC) of poro-elastic foam samples of different thicknesses (10 cm, 15 cm, 30 cm, 60 cm), calculated using the numerical method of JCA, are shown in FIG. 1. It may be observed that the SAC at low frequencies improves with thickness of the foam sample. However, a thickness of 60 cm (≈23.6 inch or about 2 feet) or more may be needed to achieve a SAC of 0.7 at 100 Hz.

The need for significant thickness compared to wavelength makes porous absorbers inefficient and not particularly useful at low frequency. To get broadband passive absorption across the frequencies of most interest to human acoustic design, usually requires a combination of resonant and porous absorption.

Sound absorption is the conversion of acoustic energy into heat through the effects of viscosity and heat conduction. The interaction of sound with solid boundaries gives rise to acoustic boundary layers in which 145 the gradients and the corresponding viscous and thermal effects are much larger than in free field. The sound absorption can be considerable, particularly when porous materials are involved. The 'contact' or 'sonified' area is then large and if the material is chosen properly, efficient absorption will result. This requires the width of the pores or channels in the material to be quite small, typically of the order of a thousandth of an inch. The absorbed energy in a porous material is proportional to the product of the 150 squared velocity amplitude within the material and the contact area referred to above.

Porous materials are usually composed of two phases, i.e., solid framework interwoven with pore network, and in the vicinity of the solid-air interface, the sound energy is consumed through viscous dissipation and heat conduction. According to the Stokes-Kirchhoff formula, the energy dissipation rate is proportional to the quadratic frequency, so porous materials can effectively absorb the acoustic waves at medium and high 155 frequencies in practical applications. To achieve satisfactory sound absorption, the minimum thickness of a porous material should generally be no less than ¼ wavelength, and this requirement constrains their wide applications in low-frequency sound absorption, especially in limited spaces.

Reactive impedance describes the non-propagating part of the acoustic field that is merely flowing back and forth. In general, the reactive impedance points out a source, corresponding to the radiation impedance being mass-like. The amount of power is reflected or stored by the medium and is termed as reactive energy which does nor propagate away from the source. In general, reactive impedance of a medium reflects sound waves and forces them not to propagate further. Consequently, The normal incidence absorption coefficient of the porous material $\alpha(0)$ can equal unity only if $x_n$ (i.e., reactive impedance) equals zero and $r_n$ equals unity.

$$\alpha(\varphi) = \frac{4r'_n\cos\varphi}{(1 + r'_n\cos\varphi)^2 + (x'_n\cos\varphi)^2}$$

Although a great deal of investigation has been conducted in the past on the sound absorptive properties of porous materials, it is still necessary to improve the low-frequency sound absorption performance of porous materials, especially for compact acoustic structures in the control of noise in the low-to-mid frequency range.

Due to inherent properties induced by large wavelength, the attenuation and manipulation of low-frequency sound waves is quite difficult to realize with traditional acoustic absorbers, yet particularly critical to modern designs. The advent of acoustic metamaterials and intelligent materials provides possibilities of energy dissipation mechanisms other than viscous dissipation and heat conduction in conventional porous sound absorbers, and therefore inspires new strategies on the design of sub-wavelength-scale structures.

Because to the stiffness and the density of the frame of the poro-elastic foam, the acoustic field in the air can generate a noticeable frame-borne wave at the $\lambda/4$ resonance of the frame. The acoustic behavior of the foam is very sensitive to the frame vibration in the vicinity of the frame resonance frequency, $f_r$. In the vicinity of $f_r$, the frame stiffness can have a great influence on both the absorption coefficient and the radiation efficiency. The frame resonance frequency depends on the elastic modulus, density and Poisson's ratio of the frame of the porous material.

A Publication, "*A new hybrid passive/active noise absorption system*," Acoustical Society of America, 101(3), 1512-

1515 (1997), by S. Beyene and R. A. Burdisso, proposed a hybrid passive/active system for sound absorption over a wide frequency range. The system comprised of a layer of absorbing material positioned at a distance from an active wall, leaving an air space. The motion of the active wall was based on an active control approach, which consisted of the minimization of the reflected wave within the airspace, which modifies the layer's back surface impedance so as to match the characteristic impedance of air. This method, however, uses active control method with a feed-forward single-channel-filtered X-LMS controller using an error signal and needs electrical power, electronic components, wiring, etc. made it difficult, if not prohibitive, for practical application.

A Publication, "*Towards acoustic metafoams: The enhanced performance of a poroelastic material with local resonators*," Journal of the Mechanics and Physics of Solids, 2019, by Lewinska et al, studied acoustic performance of a poroelastic material enriched with resonators embedded in the pores. This study, however, only attempts to increase absorption at the resonator's tuned frequency and does not result in a broadband effect.

It is well known that when the acoustic impedances of the two media are very different, most of the sound energy will be reflected, rather than transferred across the boundary.

Sound waves from the ambient medium, (i.e., air, for example) upon entering porous/poro-elastic media, on the front side, are subjected to complex acoustic impedance of porous media. When the sound waves from the ambient medium (i.e., air) reach the transition of reactive dominated impedance in the foam, there is a strong possibility that significant portion of the incident wave will be reflected, rather than transmitted into the foam. For maximum transmission to be achieved, an intermediate matching impedance device between the two regions is needed.

The acoustic impedance of the foam represents its "opposition" to the volume velocity transfer and governs its reaction in terms of acoustic pressure.

Recently, Mathur has proposed a passive acoustic impedance matching device to maximize sound power transmission over a broadband frequency range from the loudspeaker to ambient medium based on acoustic metamaterial approach [U.S. patent application Ser. No. 17/539,304 (2021)].

Metamaterials are broadly defined as artificial composite materials specifically engineered to produce desired unusual properties not readily available in nature.

Accordingly, there is a need for a passive impedance matching device for enhancing acoustic performance of porous/poro-elastic sound absorbing materials by achieving impedance matching of sound transmission into such media that are coupled with ambient medium.

SUMMARY OF DISCLOSED TECHNOLOGY

The present disclosed technology specifies an acoustic metamaterial (AMM) passive impedance matching device and system, designed to provide optimum impedance for sound transmission from the ambient medium in to the poro-elastic/porous media to significantly improve their broadband acoustic performance and to overcome the adverse complex impedance load presented by such media. The AMM device includes a combination of resistive and inductive acoustic elements to match the resistive and reactive features of the impedance load of the porous/poro-elastic medium. A combination of resistive and a reactive impedance including inductive elements in the transmission line model are used for enhancing the performance of poro-elastic/porous media over the broad band frequency range. Passive management of acoustics of the impedance of porous/poro-elastic materials thus can be achieved with various compatible configurations of the AMM impedance matching device.

In some embodiments, the acoustic metamaterial passive impedance matching devices, includes a combination of perforated screens and tubes integrated into the poro-elastic/porous medium itself, generating a complex acoustic impedance that matches the acoustic impedance of the poro-elastic/porous media.

In some embodiments, the system of open tubes includes a plurality of open tubes spaced strategically around circumference of the porous/poro-elastic media.

In certain embodiments, the plurality of open tubes and perforated screens can be designed in conjunction with porous/poro-elastic media characteristics.

In other embodiments, there may be plurality of open tubes to provide necessary inductive reactance.

In some embodiments, plurality of open tubes matches with respect to each other and with the plurality of perforated screens.

In some embodiments, the number of open tubes per volume may be different, such that the topmost surface includes more open tubes while the lowermost surface includes the similar number or less number of open tubes.

In certain embodiments, the number of open tubes and the number of perforated screens are functions of the acoustic impedance of the acoustic impedance of the porous/poro-elastic media.

In other embodiments, the dimension of the open tubes and perforated screens is a function of the acoustic impedance of porous/poro-elastic media.

In some embodiments, the open tubes increase in diameter from the upper end to the lower end, such that the distance furthest from the ambient medium and porous/poro-elastic media boundary includes the largest diameter and the volume closest to the boundary includes the smallest diameter.

In some embodiments, the open tubes are uniform in diameter from the upper end to the lower, such that the open tubes include substantially equal diameters.

"Metamaterial" refers to "any material engineered to have a property that is not found in naturally occurring materials, which may be made from assemblies of multiple elements fashioned from composite materials such as metals and plastics". "Impedance" refers to "the effective resistance of an electric circuit or component to alternating current, arising from the combined effects of ohmic resistance and reactance." "Inductance" refers to "the property of an electric conductor or circuit that causes an electromotive force to be generated by a change in the current flowing." "Resistance" refers to "the degree to which a substance or device opposes the passage of an electric current, causing energy dissipation." "Capacitance" refers to "the ratio of the change in an electric charge in a system to the corresponding change in its electric potential." "Radiation" refers to "the emission of energy as electromagnetic waves or as moving subatomic particles, especially high-energy particles which cause ionization." "Resonance" refers to "increased amplitude that occurs when the frequency of a periodically applied force is equal or close to a natural frequency of the system on which it acts." "Resonance frequency," also know as "resonant frequency," refer to "the natural frequency where a medium vibrates at the highest amplitude." "Resonator" consists of "an electronic device consisting of a combination of elements having mass and compliance whose acoustical reactances cancel at a given frequency." "Acoustic transducer" refers to "a device that converts acoustic energy to electrical or mechanical energy." "Bulk modulus" refers to "the ratio of the infinitesimal pressure increase to the resulting relative decrease of the volume of a substance." "Anisotropic" refers to "having a physical property that has a different value when measured in different directions, or varying in magnitude according to the direction of measurement." "Resistor" refers to "a device having a designed resistance to the passage of an electric current." "Porous" and "poro-elastic" are used interchangeably to describe sound absorbing materials.

Any device or step to a method described in this disclosure can comprise or consist of that which it is a part of, or the parts which make up the device or step. The term "and/or" is inclusive of the items which it joins linguistically and each item by itself. "Substantially" is defined as "at least 95% of the term being described" and any device or aspect of a device or method described herein can be read as "comprising" or "consisting" thereof.

DETAILED DESCRIPTION OF EMBODIMENTS OF THE DISCLOSED TECHNOLOGY

Figure 1A:
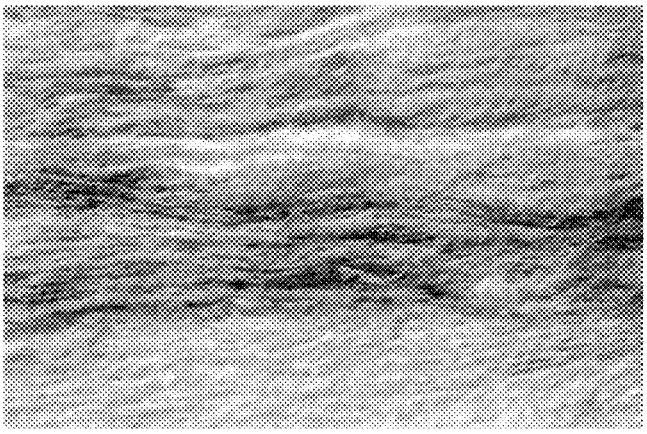
FIG. 1A shows a sound absorbing material comprising a fiberglass blanket according to one embodiment of the present disclosed technology.
Figure 1B:
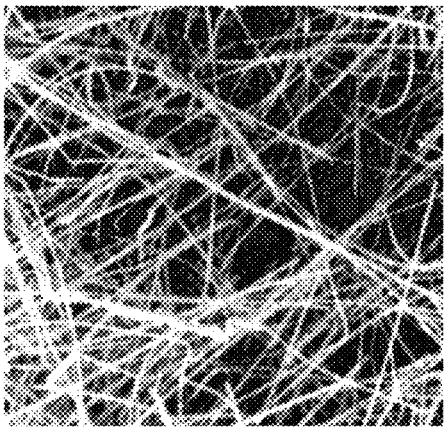
FIG. 1B shows the fiberglass blanket of FIG. 1A on a microscopic scale according to one embodiment of the present disclosed technology.
Figure 1C:
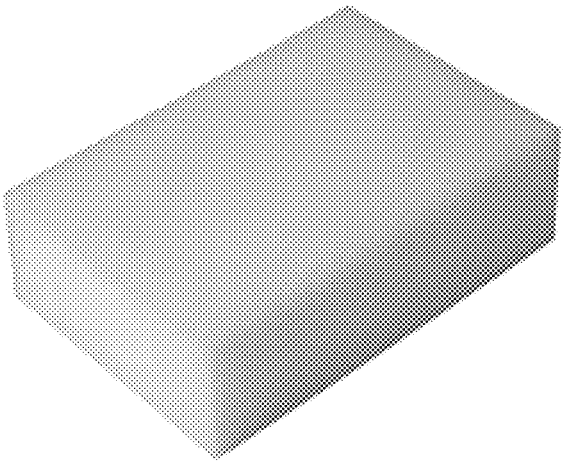
FIG. 1C shows a sound absorbing material comprising a melamine foam according to one embodiment of the present disclosed technology.
Figure 1D:
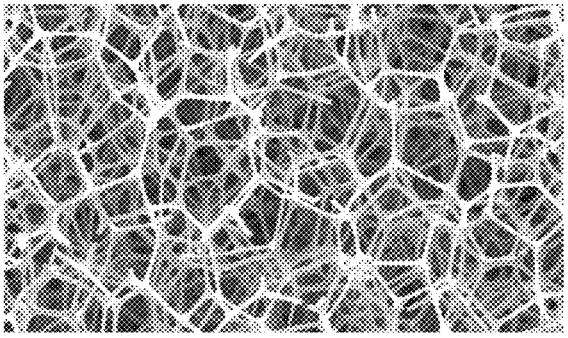
FIG. 1D shows the melamine foam of FIG. 1C on a microscopic scale according to one embodiment of the present disclosed technology.

The main objective of this disclosure is to devise a passive method for management of acoustics and impedance matching for porous/poro-elastic sound absorbing materials with the ambient medium to maximize their sound absorption and enhance their sound absorption performance over a wide frequency range using acoustic metamaterial (AMM) principles.

The present disclosed technology provides an acoustic metamaterial passive impedance matching system for use in porous/poro-elastic sound absorbing materials to match the complex acoustic impedance of the material with the ambient medium. The acoustic impedance device consists of an arrangement of inductive elements of open tubes, which connect poro-elastic medium to the ambient medium to provide passive impedance matching. The device may include a plurality of open tubes extending along the edges/circumference. An open tube of predetermined dimensions representing defines an acoustic inductance and resistance. A system of AMM inductive channels generates complex acoustic impedance that matches the acoustic impedance of the foam.

The energy dissipated within a medium as sound travels through it is analogous to the energy dissipated in electrical resistors or that dissipated in mechanical dampers for mechanical motion transmission systems. All three are equivalent to the resistive part of a system of resistive and reactive elements. The resistive elements dissipate energy (irreversibly into heat) and the reactive elements store and release energy (reversibly, neglecting small losses). The reactive parts of an acoustic medium are determined by its bulk modulus and its density, analogous to respectively an electrical capacitor and an electrical inductor, and analogous to, respectively, a mechanical spring attached to a mass.

Since dissipation solely relies on the resistive element it is independent of frequency. In practice however the resistive element varies with frequency. For instance, vibrations of most materials change their physical structure and so their physical properties; the result is a change in the 'resistance' equivalence. Additionally, the cycle of compression and rarefaction exhibits hysteresis of pressure waves in most materials which is a function of frequency, so for every compression there is a rarefaction, and the total amount of energy dissipated due to hysteresis changes with frequency. Furthermore, some materials behave in a non-Newtonian way, which causes their viscosity to change with the rate of shear strain experienced during compression and rarefaction; again, this varies with frequency. Gasses and liquids generally exhibit less hysteresis than solid materials (e.g., sound waves cause adiabatic compression and rarefaction) and behave in a, mostly, Newtonian way.

Combined, the resistive and reactive properties of an acoustic medium form the acoustic impedance. The behavior of sound waves encountering a different medium is dictated by the differing acoustic impedances. As with electrical impedances, there are matches and mismatches and energy will be transferred for certain frequencies (up to nearly 100%) whereas for others it could be mostly reflected (again, up to very large percentages).

Since bulk modulus and density of a medium control propagation of acoustic waves in the medium, it is important to focus on their variability as the wave propagates. These two parameters are analogous to the electromagnetic parameters, permittivity E and permeability μ, as can be seen in the following expression of the refractive index n and the impedance Z.

$$n = \sqrt{\frac{\rho}{B}} \text{ (acoustics)}, \; n = \sqrt{\varepsilon\mu} \text{ (electromagnetism)}$$

$$Z = \sqrt{\rho B} \text{ (acoustics)}, \; Z = \sqrt{\mu/\varepsilon} \text{ (electromagnetism)}$$

The mass density and the bulk modulus are always positive in conventional media and hard to modify because the material properties are directly associated with the chemical composition and bonding structures of the constituted atoms. However, a variety of effective acoustic parameters including negative values which never existed in nature can be obtained by metamaterials whose properties are mainly governed by the meta-atom structures that behaves like a continuous material in the bulk. According to the sign of the mass density and the bulk modulus, acoustic metamaterials can be classified to negative mass density, negative bulk modulus, double negative parameters, near-zero and approaching infinity mass density.

With, either effective mass density or effective bulk modulus of acoustic parameters being negative, a fully opaque acoustic material is possible. However, an inverse effect in which sound wave energy propagates instead of being attenuated, when both of these two parameters are negative simultaneously.

It is the intent of this patent to realize double negative parameters, with negative effective mass density and negative effective bulk modulus scheme, using passive impedance matching approach by combining various acoustic elements.

Acoustic impedance is the opposition of a medium to a longitudinal acoustic wave motion. It characterizes the relationship between the acting sound pressure and the resulting particle velocity. This impedance is called the specific acoustic impedance of the medium because it characterizes the medium itself. When a sound source transfers its energy to a medium, however, the medium opposes the movement of the source with some kind of average impedance that is dependent not only on the medium, but also on the size of the air mass pushed by the sound source.

Energy is dissipated in resistive elements. In a resistor, the current and voltage are always in phase. Inductive impedance stores energy. In inductors the current does not flow immediately upon the application of voltage. The current flow lags the voltage. In a pure acoustic inductance (no resistance), the particle velocity through lags the acoustic pressure across by 90°. Changes in velocity value and direction occur after changes in pressure and there is no dissipation of energy.

In the porous/poro-elastic foam having a complex impedance of $Z_s(\omega)$, with a negative inductive impedance $X_s(\omega)$ (see Equation 2), it can be deduced that the sound waves entering the foam will be reflected back due to the impedance mismatch and there will be very little or no dissipation of acoustic energy depending on the characteristics of $X_s(\omega)$. In fact, there has been no attempt to provide passive impedance matching of foam with the ambient medium (i.e., air/water, etc.) and as a result, some or most of the sound energy is reflected back from the foam due to impedance mismatch, thereby making them quite inefficient in the low frequency region.

The load, i.e., the surface impedance $Z_s(\omega)$, that the surrounding medium places on the porous media is an important factor. The knowledge of $Z_s(\omega)$ allows us to quantify: (1) power dissipated in the porous media; and (2) the resistive and reactive forces of the medium on the source.

The imaginary part of the porous/poro-elastic media impedance (the reactance, $X_s$) can be considered as governing the energy stored in the fluid that continually reacts with the ambient medium surface and affects or impedes the energy transfer. This stored energy does not travel away from the ambient medium into the porous media. If efficient and or maximum dissipation of sound, that is sound transmission into porous media from the ambient medium, is desired, then impedance matching between the source (e.g., ambient medium) and the porous media must be considered.

The resistive component is the only part involved in dissipation of real sound energy. Thus, the transmitted sound energy related to the real part of the resistive impedance is useful and represents the power dissipation capacity of the porous media.

The sound power used up by the reactance, on the other hand, "is 'watt-less' power, involving energy which comes from the source and then back towards the source, without ever being dissipated as sound waves and that it involves "the mass or inertial property of the air that is involved." It is "the mass reaction of the porous medium to the ambient medium", the "additional apparent mass of the porous media." "The fluid inside the porous media behaves like an effective mass".

The maximum power transfer theorem is a fundamental rule that can facilitate maximum power transfer between two circuit elements when their impedances are matched. The maximum power transfer theorem, states that a power source with source impedance $Z_s$ will transfer the maximum amount of power to a load impedance $Z_s^*$ (e.g., ambient load) which is the complex conjugate of the source impedance. The theorem includes the complex impedance (i.e., reactance), and gives a condition that maximum power transfer occurs when the load impedance is equal to the complex conjugate of the source impedance. If maximum power transfer between the ambient medium and the porous media is facilitated using the impedance matching device proposed in this invention disclosure, sound energy will propagate unimpeded into the porous media and be dissipated.

Figure 2:
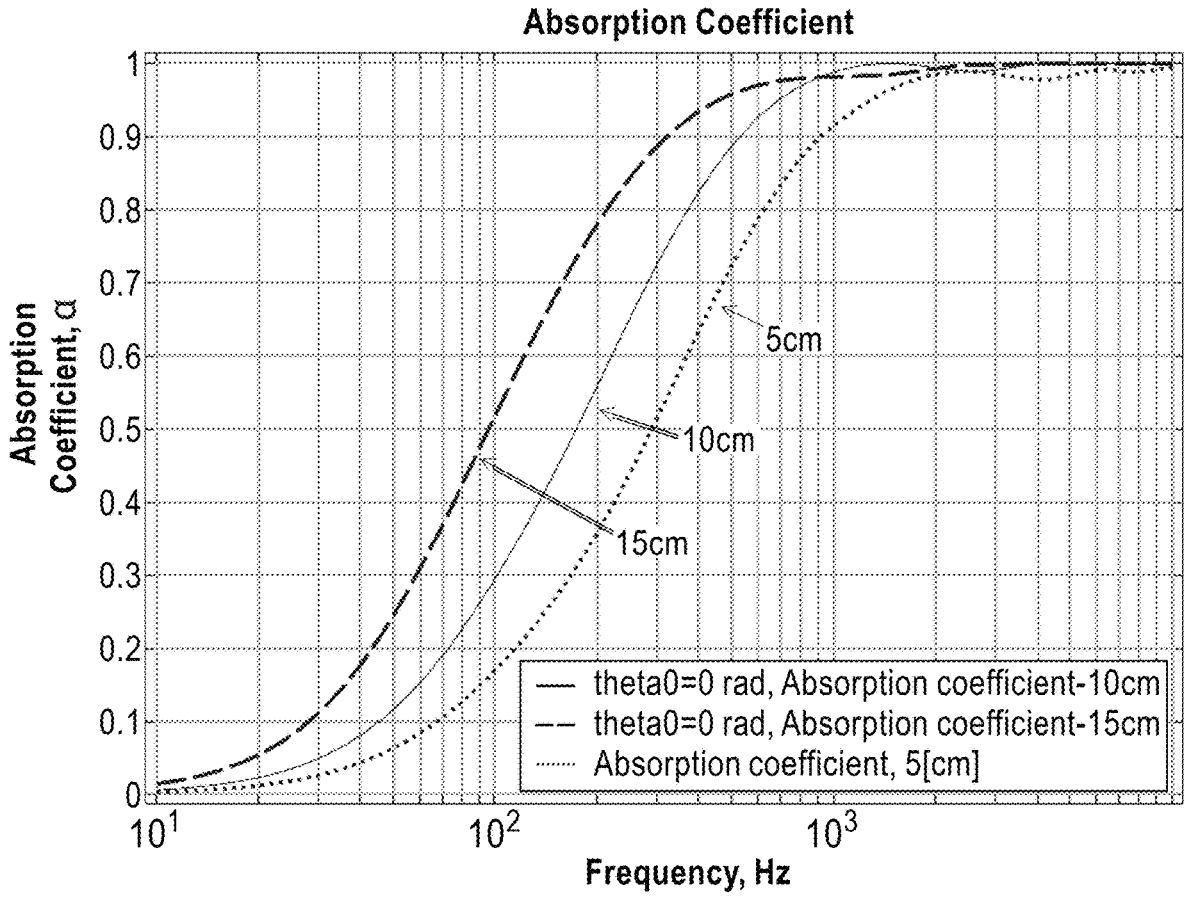
FIG. 2 shows sound absorption coefficients of poro-elastic foam samples calculated using numerical Johnson-Champoux-Allard (JCA) model according to one embodiment of the present disclosed technology.
Figure 3:
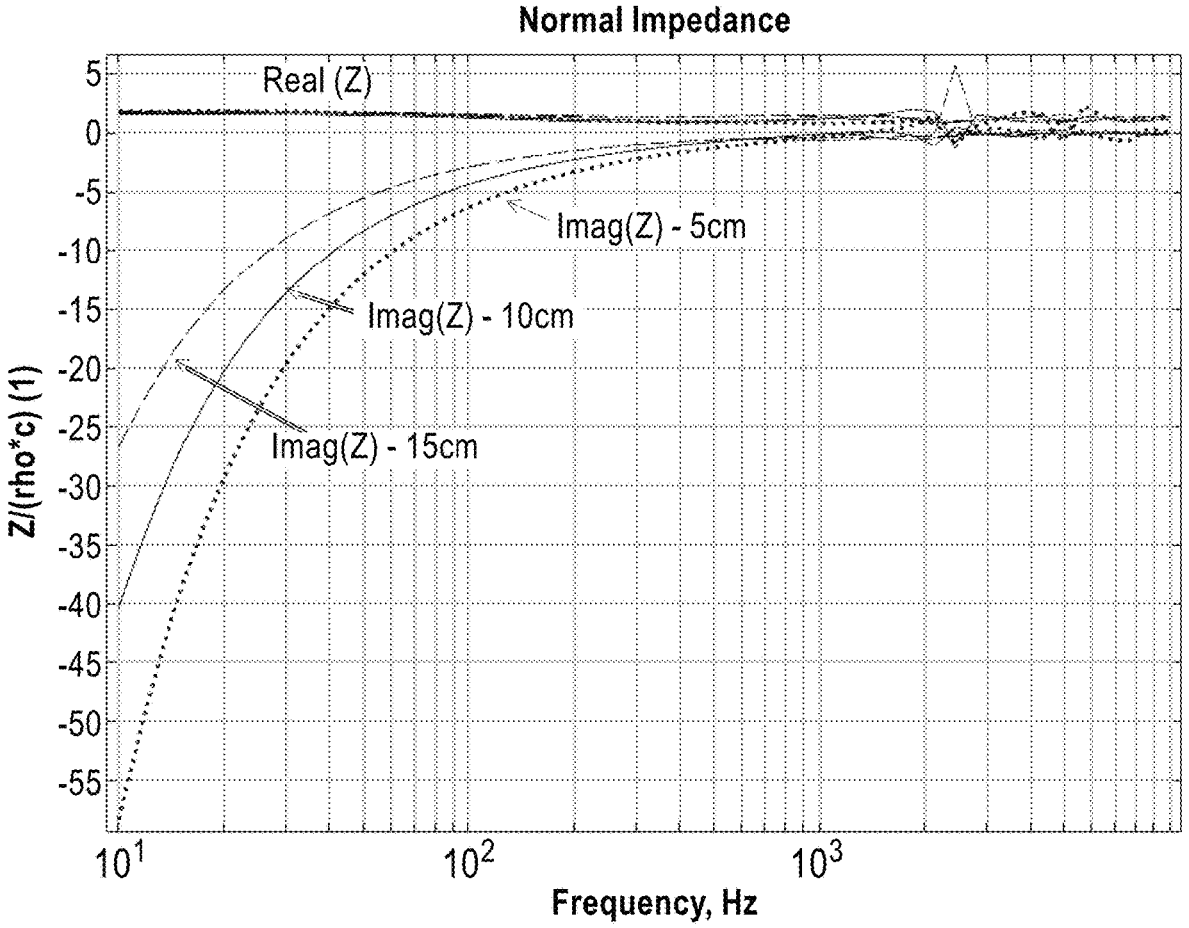
FIG. 3 shows real and imaginary parts of acoustic impedance of poro-elastic foam samples calculated using numerical Johnson-Champoux-Allard (JCA) model according to one embodiment of the present disclosed technology.

Referring to FIG. 2 and FIG. 3, simultaneously, FIG. 2 shows sound absorption coefficients of poro-elastic foam samples calculated using numerical Johnson-Champoux-Allard (JCA) model according to one embodiment of the present disclosed technology. FIG. 3 shows real and imaginary parts of acoustic impedance of poro-elastic foam samples calculated using numerical Johnson-Champoux-Allard (JCA) model according to one embodiment of the present disclosed technology. Porous/poro-elastic media can be modeled using the JCA model described earlier. 3D numerical models based on the finite element (FE) approach can be used to accurately describe acoustic behavior of the porous media taking thermo-viscous effects into consideration. FIG. 2 and FIG. 3 show sound absorption coefficient (SAC) and acoustic impedance of porous samples based on such a model using COMSOL software. FIG. 2 and FIG. 3 show the effect of reactive impedance of porous media on the SAC, particularly at low frequencies when the reactive impedance load, $X_s$, is quite high, and apparently reflecting all the incident sound energy.

The effectively dissipated power W by porous/poro-elastic media is:

$$W=Q2\times\mathrm{Real}[Z_s]$$

where, Q is volume flow (product of velocity) and $\mathrm{Re}[Z_R]$ is real (active) part of radiation impedance. The measured absolute impedance $Z_s$, imaginary part ($X_L$) and real part ($R_L$) of the impedance of porous media are shown in FIG. 3. Similarly, calculated impedance curves using analytical models are shown in FIG. 3. The imaginary part, which is the reactive part of the radiation impedance, is more dominant below 1000 Hz, whereas the resistive part is quite robust and rises at lower frequencies, as observed in FIG. 3.

The reactive part, which is inductive, implies that particle velocity lags acoustic pressure in the low frequency region (<1000 Hz). The reactive impedance, $j\omega X_L$, below 1000 Hz, of the porous/poro-elastic media is like that of an inductive element. The real part (i.e., the resistive impedance) also increases steadily below 1000 Hz.

Specific acoustic impedance (z) (characteristic impedance, wave impedance) is the opposition of a medium to wave propagation, and it depends on the medium properties and the type of wave propagating through the medium. The specific impedance of a medium opposing the propagation of a plane sound wave is equal to:

$$z=K\times\rho_0 \quad (1)$$

where K is the stiffness (e.g., bulk modulus) of the medium in N/m2 and $\rho_0$ is the density of the medium in kg/m3. The acoustic surface impedance $Z_s(\omega)$, is not a fundamental acoustical property of porous media because it depends on the dynamic density and complex compressibility through the following equations. where, $z_b(\omega)$, is the characteristic impedance of the porous media, and k(w) is the complex wavenumber.

In the low-frequency limit, an open tube is called an acoustic inductance or an inertance and it has a direct analogy to the inductance in electrical circuit analysis or the mass in mechanical system analysis. The acoustic impedance of an open tube of length, L, and area A, is then given by:

$$Z(\omega)=\{P(\omega)\}/\{U(\omega)\}=j\omega(\rho_0 L/A),$$

where, U (ω)=AV (ω) is the acoustic volume velocity of the air mass and P(w) is applied sinusoidal pressure.

Using acoustic metamaterials, acoustic wave propagation can be controlled by appropriate design of the refractive index distribution of the medium. In addition to the refractive index, the acoustic impedance also affects the sound propagation characteristics. For loudspeaker driver in the headphone, the radiation impedance allows the phase relationship between the surface pressure and the object velocity to be quantified. At lower frequencies, these two quantities are generally not in phase, with the velocity lagging behind the surface pressure by 90°.

It is possible to obtain some extraordinary acoustic fluid parameters ($\rho_0$ and $B_0$), i.e., density and bulk modulus, by modifying the structural parameters of acoustic metamaterials, that cannot be realized easily using natural materials. These parameters include negative mass density and negative bulk modulus values, anisotropic mass density tensors, and anisotropic elasticity tensors.

Figure 6A:
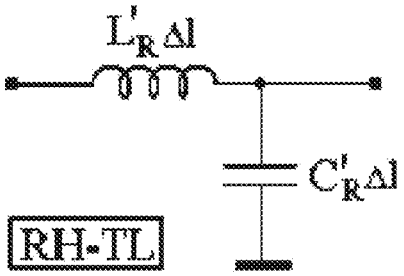
FIG. 6A shows equivalent circuits with distributed elements for a cell of Right-Handed (RH)-TL according to one embodiment of the present disclosed technology.
Figure 6B:
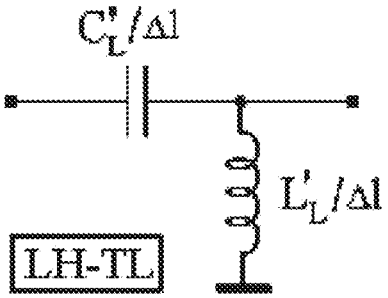
FIG. 6B shows equivalent circuits with distributed elements for a cell of Left-Handed (LH)-TL according to one embodiment of the present disclosed technology.
Figure 6C:
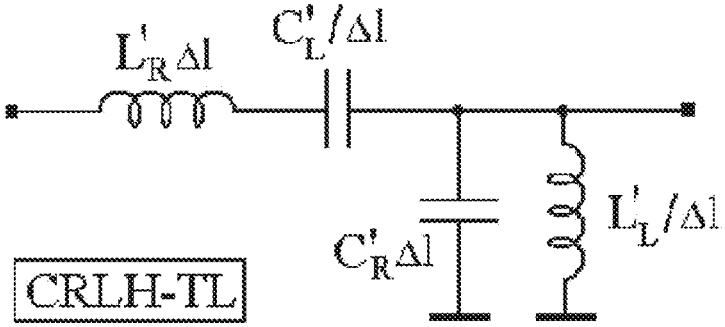
FIG. 6C shows the distributed equivalent circuit for a cell of CRLH-TL according to one embodiment of the present disclosed technology.

Referring now to FIG. 6A, FIG. 6B, and FIG. 6C, simultaneously, FIG. 6A shows equivalent circuits with distributed elements for a cell of Right-Handed (RH)-TL according to one embodiment of the present disclosed technology. FIG. 6B shows equivalent circuits with distributed elements for a cell of Left-Handed (LH)-TL according to one embodiment of the present disclosed technology. FIG. 6C shows the distributed equivalent circuit for a cell of CRLH-TL according to one embodiment of the present disclosed technology. Recently, metamaterials with simultaneously negative permittivity (E) and permeability (μ), more commonly referred to as left-handed (LH) materials, have received substantial attention. In the realm of electromagnetics, there is a common distinction between two types of metamaterials: arrays of resonant inclusions, such as the split-ring resonator and transmission line (TL) based metamaterials. While the materials of the upper kind are inherently narrow band and lossy due to their resonant nature, the latter can exhibit the desired meta-properties, such as negative refraction, over a much larger bandwidth and with lower losses since they do not explicitly rely on resonance.

Most of the acoustic metamaterials reported to date belong to the category of resonant additions, whereas very few works on the acoustic counterparts of TL-based metamaterials have been reported. This requires the realization of acoustic or mechanical elements, which implement shunt "inductances" (i.e., acoustic masses) and series "capacitances" (i.e., acoustic compliances).

Left-handed materials (LHMs), which in a wider sense, are also referred to as negative index materials (NIMs), simultaneously have negative permittivity, E, negative permeability, μ, and negative refractive index, n, over a common frequency band. The term "left-handed material" (LHM) was first introduced by Veselago in 1968, who predicted there exists such a medium in which the electric field, E, the magnetic field, H, and the wave vector, k, form a left-handed orthogonal set. However, left-handed materials do not exist in nature.

Transmission line approach is based on the dual conventional transmission line. Backward wave transmission line (TL) can form a non-resonant LHM. Series capacitance (CO and shunt inductance ($L_L$) combination supports a fundamental backward wave. Perfect LH TL is not resonant dependent but has a low loss and broad-band performance.

In acoustic circuit modeling, the acoustic pressure p represents the electric voltage, and the volume velocity q flowing through a surface S substitutes for the electric current. Following this convention, an incremental section of a conventional fluid can be described by the model of FIG. 6A, where $m_a$ (i.e., $L'_R=\rho/S$) is an acoustic mass (or inertance, $L'_R$) and $C'_R$ ($=S/B_0$) is an acoustic compliance, and $\rho_0$ and $B_0$ are the density and bulk modulus of the medium (e.g., air), respectively. The corresponding wave velocity is given by $\sqrt{\rho_0 B_0}$ 340 m/s. n acoustic waveguide, for example, can be described a purely right-handed (PRH) acoustic TL structure and can be represented by the TL circuit of FIG. 6A. It describes the propagation of acoustic waves inside the waveguide with positive index of refraction. The characteristic acoustic impedance of an open-open un-baffled waveguide may be given by: $\rho_0 c\ [(ka)^2+j(0.6ka)]$ for (ka<<1) and is of the form: R+jX. The reactive impedance part (X) renders the waveguide as a PRH system with positive refractive index. The porous/poro-elastic media has a similar characteristic impedance as given in Equations (2-2).

The purely Left-Handed (PLH) TL model, shown in FIG. 6B, is the combination of a times-unit length series capacitance $C'_L$ and a times-unit length shunt inductance $L'_L$ and is the dual of the PRH TL. Such a structure is known to exhibit a negative refractive index over an infinite bandwidth. In reality, a PLH structure is not possible because of unavoidable RH parasitic series inductance (L) and shunt capacitance (C) effects (parasitic capacitance is due to development of voltage gradients, and unavoidable parasitic inductance is due to current flow along the metallization).

Considering the natural contribution of the non-vanishing connections between these two PRL and PLH circuits, the resulting periodic structure unit cell is the one shown in FIG. 6C. At low frequencies, the response is dominated by $m'_L$ and $C'_R$, resulting in a left-handed (LH) behavior (negative refractive index), whereas $m'_R$ and $C'_L$ are predominant at higher frequency, which then results in a right-handed (RH) behavior (positive refractive index). In microwave engineering, interesting applications exist where both of these bands are used, which is why this structure has been named the composite right/left-handed transmission line (CRLH TL).

An acoustic metamaterial that does not cause reflections at boundaries in all frequency regions while exhibiting positive and negative refractive index properties will be preferential. In most of the cases, an anti-reflection property was only achieved at a specific refractive index range or angle of incidence, and there have been no reports to date of an anti-reflection property being achieved for all refractive indices, including positive and negative indices, and regardless of the angle of incidence. In transmission line metamaterials, the impedance of the metamaterial can be matched with that of the air when the balanced condition is satisfied. This condition can be achieved by ensuring that the product of the shunt inductance and the capacitance has the same value as the product of the series inductance and the capacitance (e.g., $L'_R C'_L = L'_L C'_R$). The lumped series capacitance is indexed, $C'_L$, and the shunt inductance, $L'_L$. In such a balanced metamaterial, reflections can be strongly suppressed and the transmission can be maximized over the entire refractive index range.

The equivalent circuits of a cell, for RH-TL and LH-TL are shown in FIG. 6A and FIG. 6B, respectively. In these circuits, $L'_R$, $C'_R$ and $L'_L$, $C'_L$ are the distributed inductance and capacitance for RH-TL and LH-TL, respectively. For a balanced CRLH-TL, the impedance matching conditions over a large frequency domain can be easily fulfilled.

$$Z_{CRLH\text{-}TL}=Z_{LH\text{-}TL}=Z_{RH\text{-}TL}$$

The equivalent balanced circuit of CRLH-TL is a combination of the equivalent circuits for RH-TL and LH-TL. The equivalent circuit for CRLH-TL is given in FIG. 6C, where, similar to RH-TL and LH-TL, Δl must be small enough compared to the wavelength. In CRLH-TL circuit, LH circuit balances the RH circuit to give a metamaterial impedance matching condition, which is similar to putting a conjugate impedance load on the initial complex impedance load. From the maximum power transfer theorem, thus, the added matching conjugate impedance $Z^*_L$ (i.e., $R_L+X_L$) balances the existing $Z_L$ (i.e., $R_L-X_L$).

The balanced (CRLH) metamaterial approach can now be seen as an implementation of the maximum power transfer theorem. It also explains how the maximum power transfer really works and can be achieved in nature.

Circuit-theory concepts have been used to conceptualize and design an acoustic non-resonant TL-based metamaterial. Series compliances were implemented using membranes whereas the shunt acoustic masses were realized with transversally connected open channels. Such a metamaterial exhibits a negative refractive index over almost one octave (0.6-1 kHz), which is larger than what can be achieved with locally resonant acoustic metamaterials. However, one-octave coverage is very inadequate for practical applications and must be extended over at least 3 or more octaves.

In the present disclosed technology, an acoustic metamaterial impedance matching device for porous/poro-elastic media, using open-tube inductive and resistive architecture, that is impedance matched for a porous media for all refractive indices including negative indices, is disclosed. This arrangement is highly distinctive and different from previous attempts and is based on the fact that the impedance of the porous media itself, as described earlier, consists mostly of resistive and inductive elements. It is important to note that the resistive and inductive impedance of a porous media needs to be matched with a similar but conjugate environment.

The characteristic impedance of air is specific acoustic impedance (z) (characteristic impedance, wave impedance) is the opposition of a medium to wave propagation, and it depends on the medium properties and the type of wave propagating through the medium. The specific impedance of a medium opposing the propagation of a plane sound wave is equal to: $Z=\sqrt{B_0\rho_0}=\rho_0 c$, where $B_0$ is the bulk modulus of the medium in N/m2, $\rho_0$ is the density of the medium in $kg/m^3$ and c is speed of sound in m/s. Thus, Z depends on both bulk modulus and density of the medium. The pressure in a periodic sound wave can be related to the displacement:

$$\Delta P_{max}=B_0 k s^2_{max},$$

where, $B_0$ is the bulk modulus of the medium, k (=ω/c) is wavenumber, and $s_{max}$ is the displacement of sound wave. The average intensity (the rate at which the energy being transported by the wave transfers through a unit area) over one period of the oscillation is:

$$(I)_{avg} = \frac{1}{2}\sqrt{B_0\rho_0}\,\omega^2 s^2_{max}$$

where, ω is the angular frequency. Thus, power or intensity carried by sound wave is proportional to the square root of both bulk modulus and density of air.

An acoustic inductive element is analogous to an open pipe/tube. By combining acoustic inductors and resistors in a series acoustic element, a device with negative refractive index can be achieved. The acoustic mass is equivalent to the mass of the air in the enclosed element divided by the square of the cross-sectional area of the element. Also, since some small volume of the medium on either end of the tube is also entrained with the media inside the tube, the "acoustic" length is usually somewhat larger than the physical length of the tube. For a single open end, the difference between the physical length and the acoustic length is $\Delta 1 \approx 0.8a$, also called the end correction. A structure that may be well approximated by an acoustic compliance is an enclosed volume of air with linear dimensions ($<0.1\lambda$). The variations in sound pressure within an enclosed air volume generally occur about the steady-state atmospheric pressure, the ground potential in acoustics.

The basic constituent parameters that determine the propagation characteristics of acoustic waves in a medium are the density of the medium $\rho_0$ and its bulk modulus $B_0$. The velocity of an acoustic wave in the medium c and the refractive index relative to air n are given by:

$$c = \sqrt{\frac{B_0}{\rho_0}}\,;\; n = \sqrt{\frac{\rho_r}{B_r}}$$

where, $B_r=B/B_0$ and $\rho_r=\rho/\rho_0$ are the relative values of the bulk modulus and the mass density of the medium, respectively, with respect to values in air, which are $B_0=1.42\times105$ Pa and $\rho_0=1.22$ kg/m3.

When open tubes (OTs) are installed periodically as lumped elements in a one-dimensional acoustic waveguide, the pressure amplitude in the waveguide is affected by the dynamic motion of the air column that exists in the OT, and the value of the bulk modulus thus changes. In this case, the bulk modulus of the medium B is given by:

$$B=B_0/[1-(\omega^2{}_{OT}/\omega^2)],$$

where, the transition frequency of the bulk modulus is given by:

$$\omega_{OT} = c\sqrt{\frac{S}{l'dA}}$$

and, if only OTs have been installed, the mass density of the metamaterial p is equal to that of air $\rho_0$. Here, c, S, d, and A are the speed of sound in air, the cross-sectional area of the OT, the effective length of the OT, the unit cell length, and the cross-sectional area of the waveguide, respectively.

Figure 7:
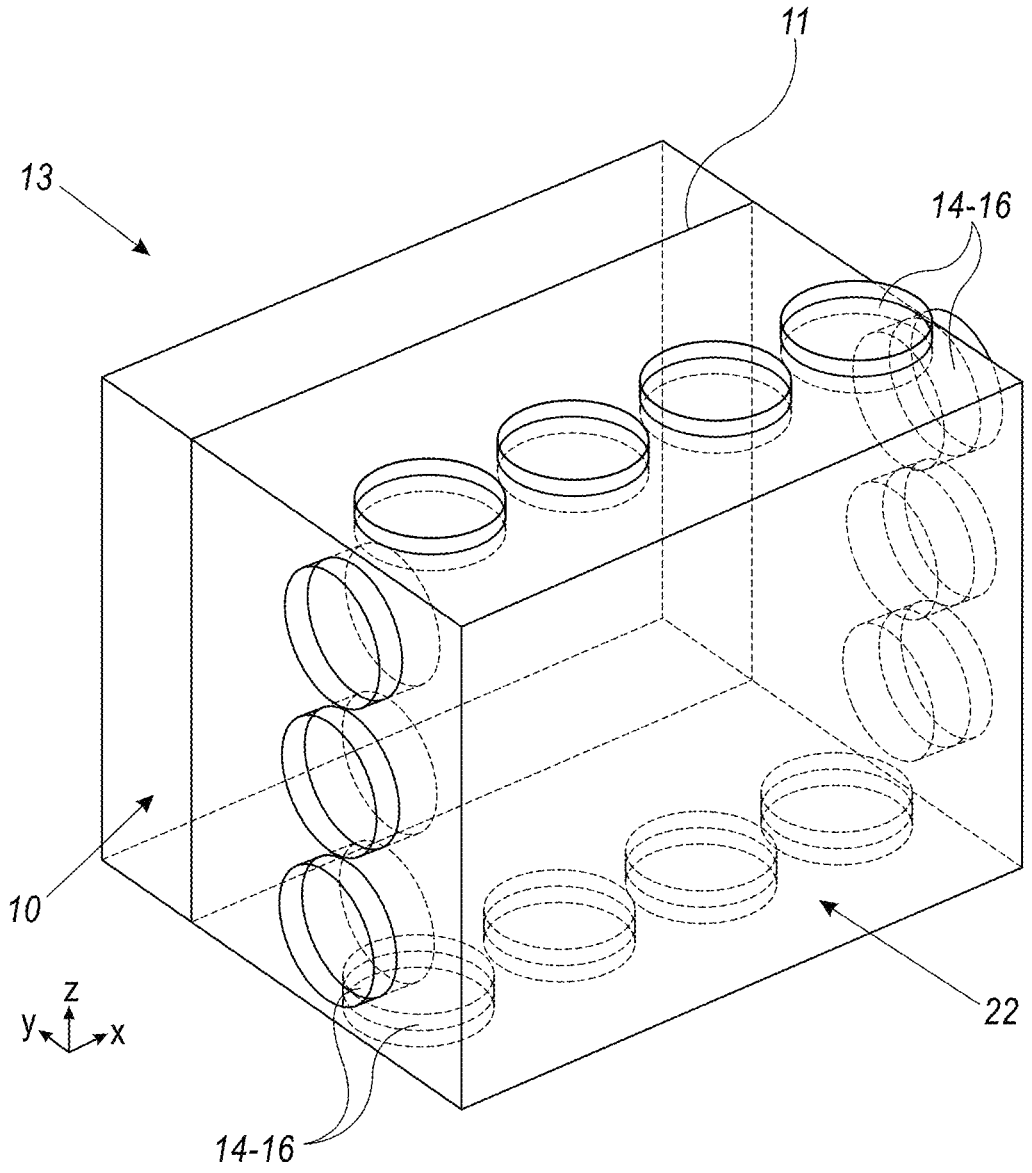
FIG. 7 shows a schematic view of AMM impedance matching device consisting of open tubes and perforated screen in a block of poro-elastic foam backed by a hard wall according to one embodiment of the present disclosed technology.
Figure 8:
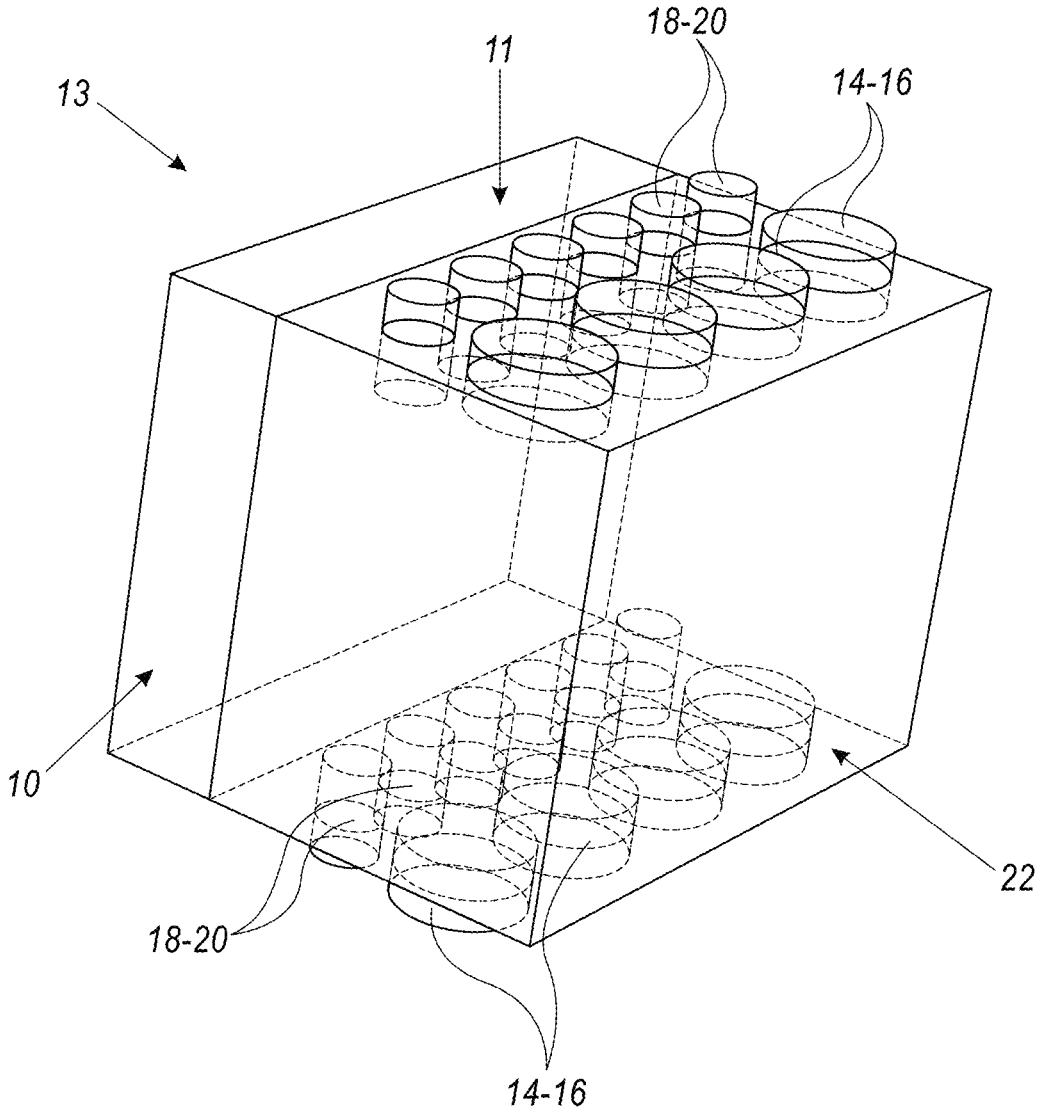
FIG. 8 shows a schematic view of AMM impedance matching device consisting of open tubes and perforated screen in a block of poro-elastic foam backed by a hard wall according to one embodiment of the present disclosed technology.
Figure 9:
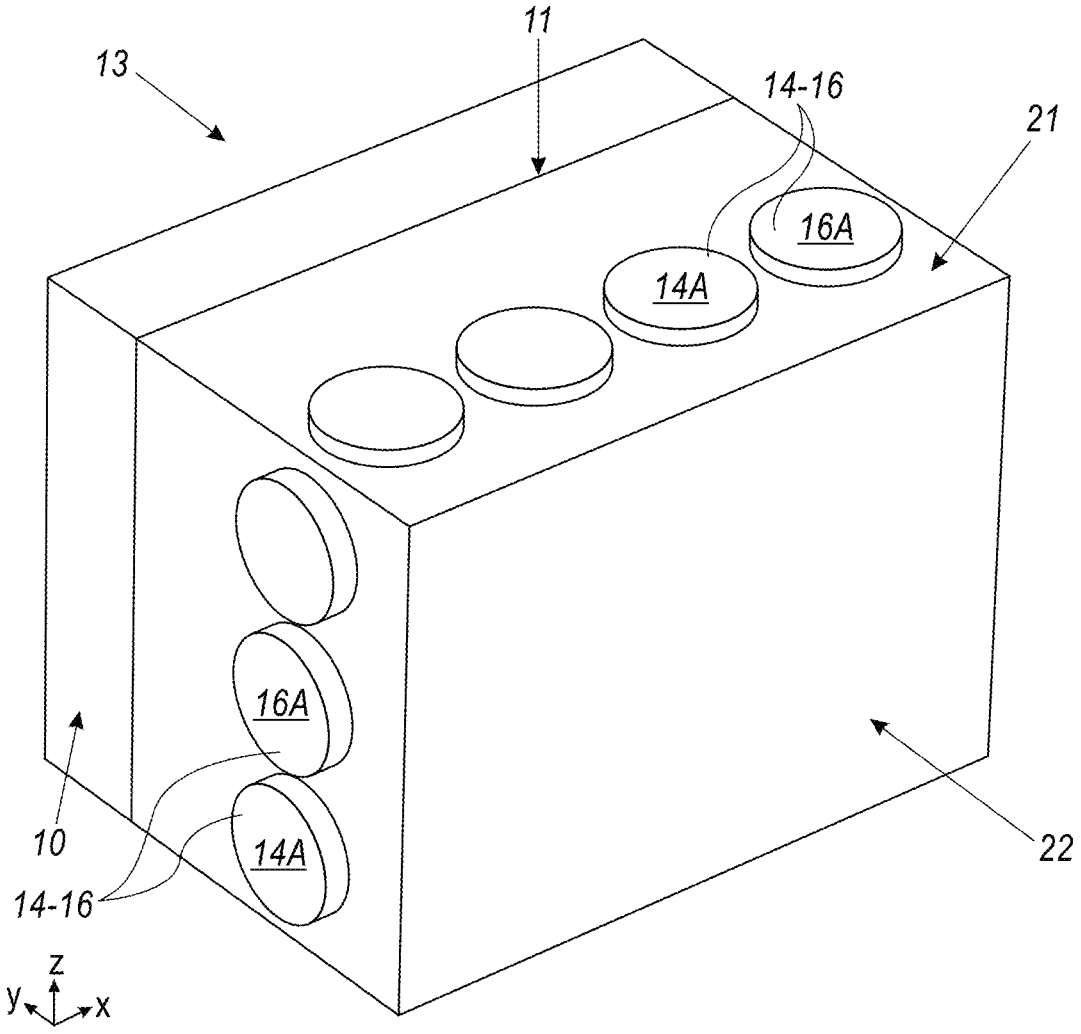
FIG. 9 shows a schematic view of AMM impedance matching device consisting of open tubes and perforated screen in a block of poro-elastic foam backed by a hard wall according to one embodiment of the present disclosed technology.

The two types of unit cells, e.g., open tubes with resistive elements can be combined to obtain a new complex unit cell, as shown in FIG. 7, FIG. 8, and FIG. 9, discussed in more detail below, which can be used to modify the mass density and bulk modulus, needed to modify resistance and reactance, in the porous media simultaneously. Porous media impedance is simulated by appropriate selection of the design parameters (e.g., A, L, d) of the inductance and resistance (i.e., the inductive tube/channel and open holes).

Figure 5A:
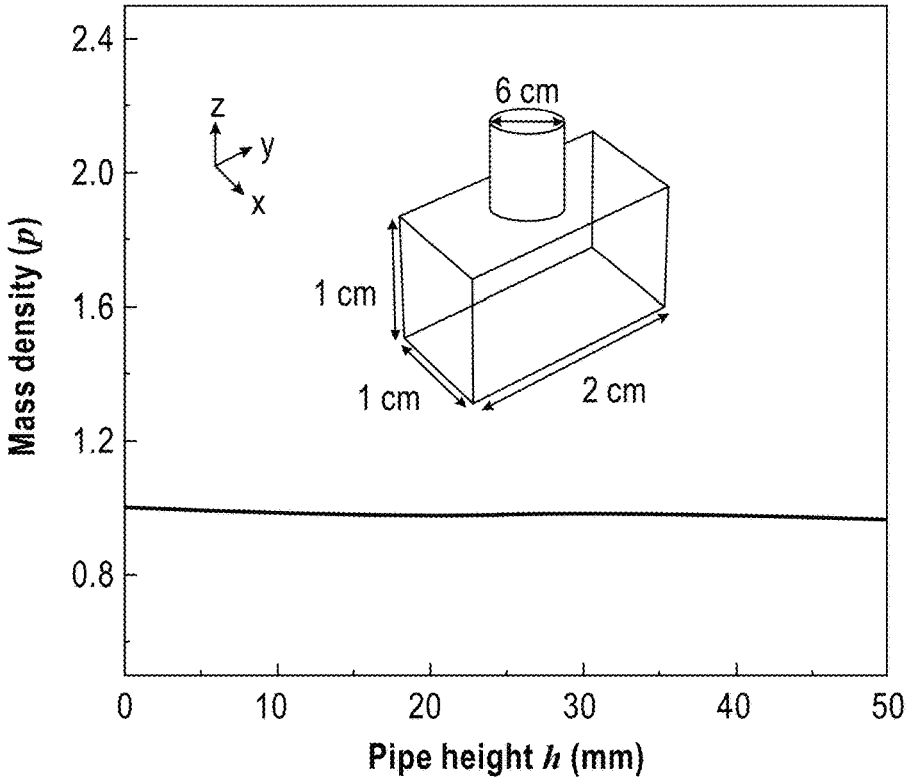
FIG. 5A shows a unit cell with a side pipe within a graph showing the mass density with respect to the geometrical parameters of the unit cell with the side pipe according to one embodiment of the present disclosed technology.
Figure 5B:
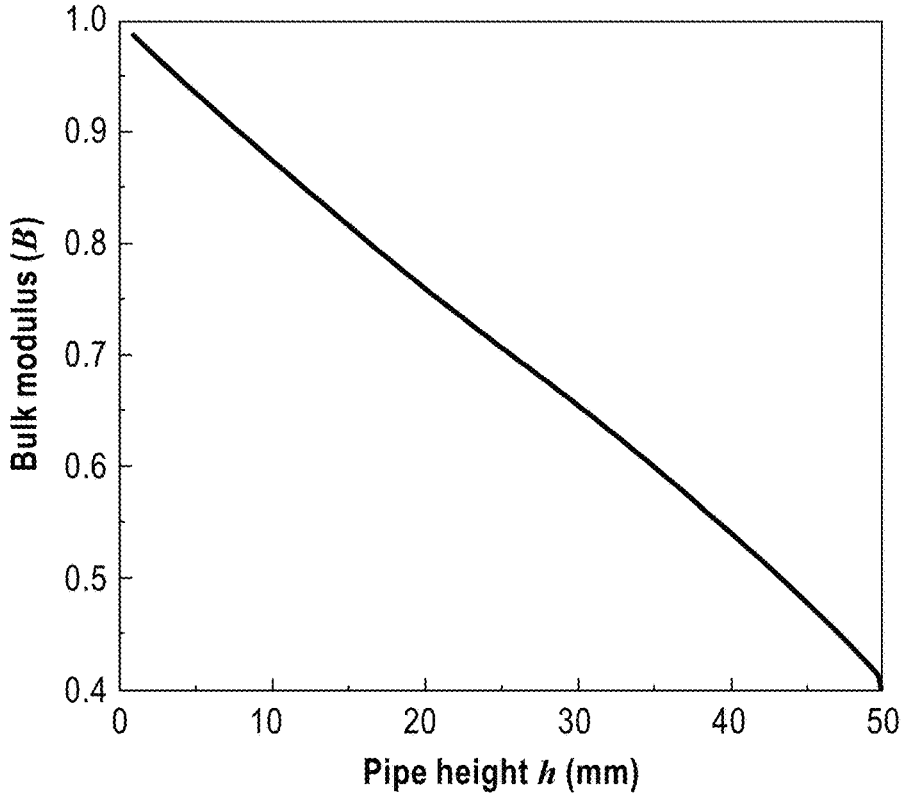
FIG. 5B shows a graph showing the bulk modulus with respect to the geometrical parameters of the unit cell with the side pipe according to one embodiment of the present disclosed technology.

Referring now to FIG. 5A and FIG. 5B, simultaneously, FIG. 5A shows a unit cell with a side pipe within a graph showing the mass density with respect to the geometrical parameters of the unit cell with the side pipe according to one embodiment of the present disclosed technology. FIG. 5B shows a graph showing the bulk modulus with respect to the geometrical parameters of the unit cell with the side pipe according to one embodiment of the present disclosed technology. A side tube in a unit cell could be used to modulate the bulk modulus of the medium by varying the side tube's height. The change in pressure in the main tube is $p=-B_0(\Delta V-\Delta V_h)/V$, and the change in pressure in the side tube is $p_h=-B_0DV_h=\Delta V_h/V_h$. Here, V and $V_h$ represent the volumes of the main tube and the side tube, respectively, while $\Delta V$ and $\Delta V_h$ are the small changes in the main tube and side tube volumes, respectively. The effective bulk modulus is only dependent on the observable volume change $\Delta V$, and thus, the formula becomes $p=-B_{eff}\Delta V/V$. Because $p=P_h$, the effective bulk modulus is given by $B_{eff}=B_0/(1+V_h/V)$, which means that as the height of the side tube increases, the effective bulk modulus decreases.

Figure 4A:
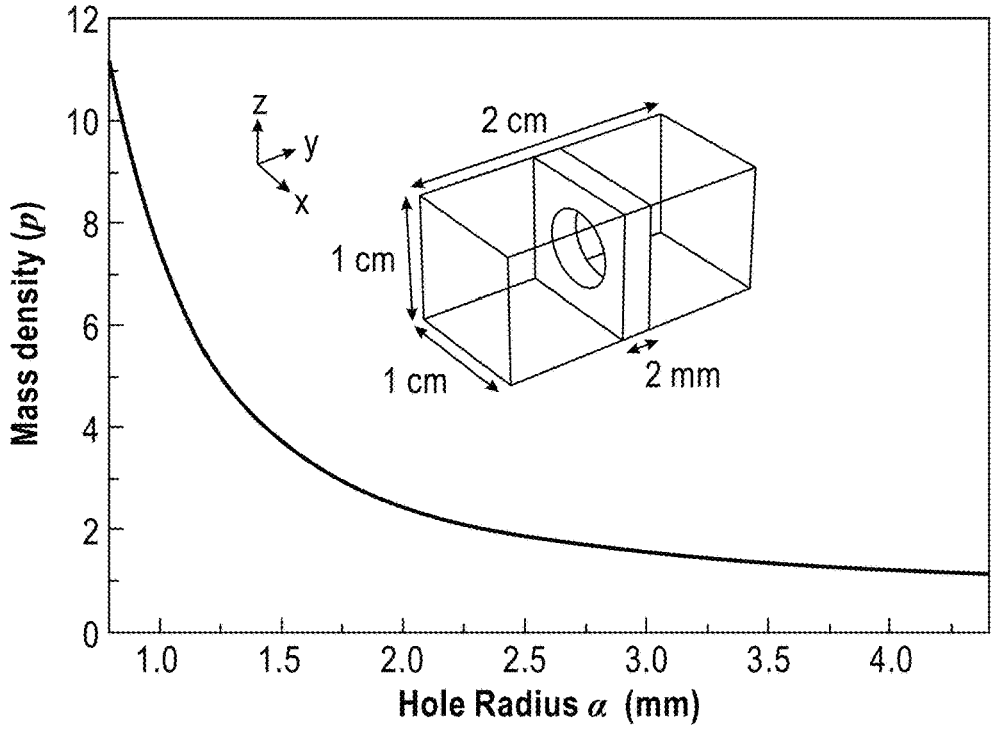
FIG. 4A shows a unit cell with a perforated plate within a graph showing the mass density with respect to the geometrical parameters of the unit cell with the perforated plate according to one embodiment of the present disclosed technology.
Figure 4B:
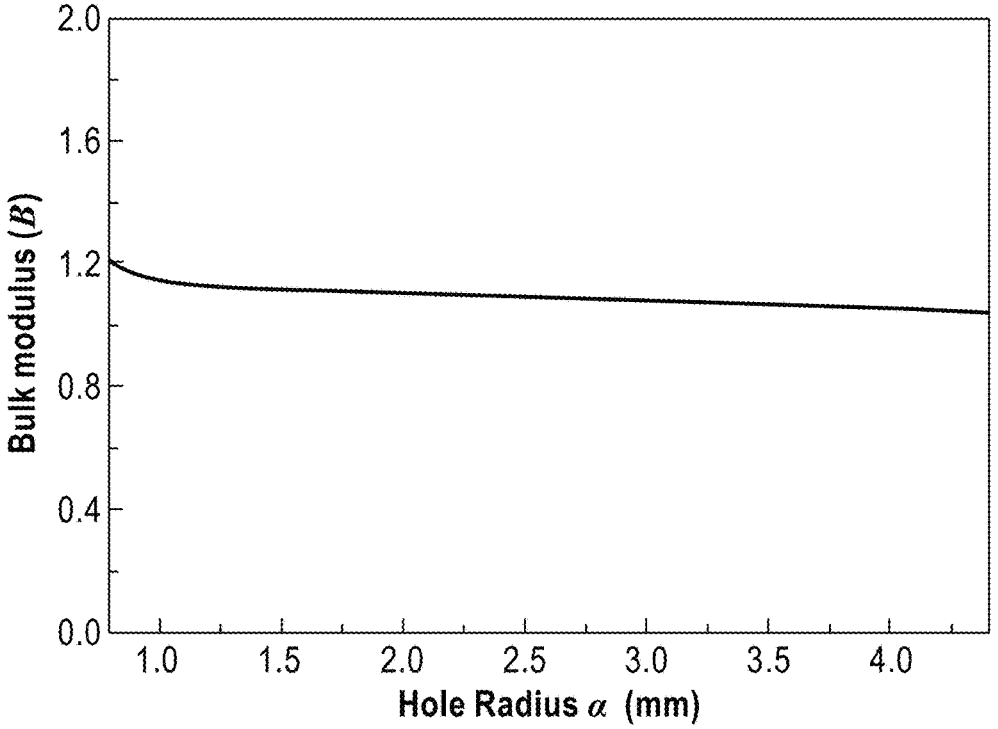
FIG. 4B shows a graph showing the bulk modulus with respect to the geometrical parameters of the unit cell with the perforated plate according to one embodiment of the present disclosed technology.

Referring now to FIG. 4A and FIG. 4B, simultaneously, FIG. 4A shows a unit cell with a perforated plate within a graph showing the mass density with respect to the geometrical parameters of the unit cell with the perforated plate according to one embodiment of the present disclosed technology. FIG. 4B shows a graph showing the bulk modulus with respect to the geometrical parameters of the unit cell with the perforated plate according to one embodiment of the present disclosed technology. The action of an acoustic resistor is to absorb sound power. The viscous forces within a narrow tube convert the sound power into heat that dissipates away. A narrow tube or radius a ($<<0.001\lambda$) can represent an acoustic resistor. Thus, a perforated plate with miniature holes can provide desired resistance. The perforated plate can be regarded as a tiny pipe with an impedance of $Z'_0=\rho_0c_0/S$. Thus, the variation of the sectional area of the hole is equivalent to the variation of the effective mass density, where a larger radius leads to a smaller effective mass density. A unit cell with a perforated plate, as shown in FIG. 4A, can be used to modulate the mass density of the medium by varying the radius of the hole. The size and shape of the perforation determines the momentum in the rigid plate produced by a wave propagating perpendicular on the plate, and, therefore, can be used to control the corresponding mass density component seen by this wave. This property is used to obtain the higher density component. If, on the other hand, the wave propagates parallel to the plate, it will have a very small influence on it, and consequently the wave will see a density close to that of the background fluid. The compressibility of the cell, quantified by the lower effective parameter, the bulk modulus, is controlled by the fractional volume occupied by the plastic plate.

In the case of an acoustic metamaterial with a composite structure in which perforated plates and open channels, each lumped element affects the constituent parameters of the medium independently. The static density of the medium then becomes $\rho'$ rather than $\rho_0$ because of the effect of the perforated plate, and the transition frequency of the bulk modulus should be modified to take the form $\omega_{OT}=c\sqrt{(\rho S/\rho_0 l'dA)}$, which comes from the continuity equation of the medium.

Referring to FIG. 7, FIG. 8, and FIG. 9, simultaneously, FIG. 7 shows a schematic view of AMM impedance matching device consisting of open tubes and perforated screen in a block of poro-elastic foam backed by a hard wall according to one embodiment of the present disclosed technology. FIG. 8 shows a schematic view of AMM impedance matching device consisting of open tubes and perforated screen in a block of poro-elastic foam backed by a hard wall according to one embodiment of the present disclosed technology. FIG. 9 shows a schematic view of AMM impedance matching device consisting of open tubes and perforated screen in a block of poro-elastic foam backed by a hard wall according to one embodiment of the present disclosed technology.

The AMM passive impedance matching device is shown with resistive perforated screen 11 and open tubes 14, 16 integrated with a porous foam block 10. In embodiments, sound waves 13 travel to the AMM passive impedance matching device and through the perforated screen 11. The dimensions of the open tubes 14, 16 depend on the acoustic inductance required. Inductive reactance of the porous media determines the dimensions and number of open tubes 14, 16.

In some embodiments, a plurality of open tubes 14, 16 are spaced around the outside surface 21 to the main foam block 10. In other embodiments, the plurality of open tubes 14, 16 and the perforated screen 11 alternate in arrangement. The plurality of open tubes 14, 16 each include one side of the open ends 14A, 16A to the outside, and the other side of the open ends to the inside of the foam block 10, to provide the desired inductive reactance.

In view of the foregoing, the number of open tubes 14, 16 are functions of the impedance of the foam block 10. Indeed, the quantity of the open tubes 14, 16 and the pattern and the number of the perforated screens 11 are dependent on the impedance of the porous media 10. Further, the dimension of the open tubes 14, 16 is a function of the reactance of the porous media 10. Indeed, the dimensions of the open tubes 14, 16 and perforated screens 11 are dependent on the reactive impedance of the porous media 10.

In embodiments, the AMM impedance matching device consists of open tubes 14, 16, 18, 20 and a perforated screen 11 in a block of poro-elastic foam 10 backed by a hard wall 22. In embodiments, the AMM passive impedance matching device is situated outside a porous foam block 10. The AMM passive impedance matching device is based on resistive and inductive TL elements. The inductive elements are implemented using open tubes 14, 16, which are open at both ends. The open tubes 14, 16 are partially submerged inside the foam block.

In embodiments, the plurality of open tubes 14, 16 further comprises a second set of open tubes 18, 20 in addition to the inductive reactance provided by the first set of open tubes 14, 16, as shown in FIG. 8. These open tubes 14, 16, 18, 20 are partially submerged inside the porous foam block 10 to provide a predetermined amount of reactive impedance.

Figure 10:
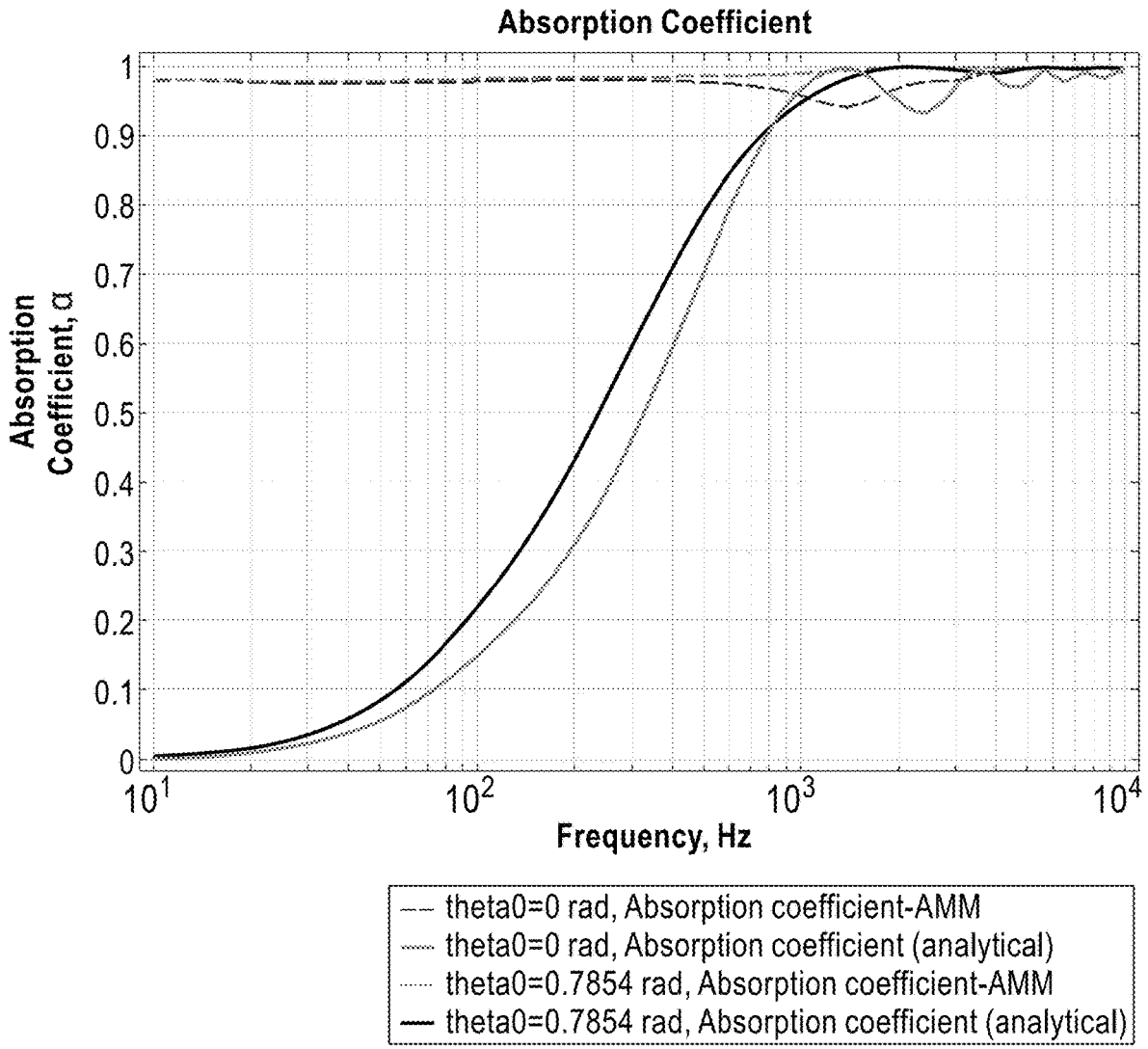
FIG. 10 shows sound absorption coefficient of a 3-inch (7.62 cm) thick AMM poro-elastic foam sample, calculated using the Johnson-Champoux-Allard (JCA) model according to one embodiment of the present disclosed technology.

Referring now to FIG. 10, FIG. 10 shows the predicted sound absorption coefficient of a 3-inch (7.62 cm) thick poro-elastic foam sample with AMM impedance matching device, calculated using the numerical Johnson-Champoux-Allard (JCA) model, compared with that of the baseline foam sample without the AMM device. The predicted curves using the JCA model for both 0 degree and 45 degree (0.784 radians) incidence are shown in FIG. 10. It may be observed that the AMM impedance matching device improves the sound absorption coefficient (SAC) of the porous foam block to almost 0.98-1.0 over the entire frequency range of 10-10000 Hz, whereas the baseline foam block shows a SAC of near 1.0 only over the frequency range of 1100-10000 Hz. There is a small frequency range of 1000-2000 Hz, where the SAC of the AMM foam block is slightly lower (about 0.96-0.99), which can be improved by adjusting the impedance using the resistive elements of the AMM impedance matching device.

The portals of embodiments of the disclosed technology pass all the way through walls to allow dissipation of energy, while at the same time, taking into account reactive impedance of the form/wall materiel. The active impedance of the foam is canceled, at least partially or substantially fully with the tubes which extend, bulge, or exit from the foam/wall. The velocity and pressure of the sound waves simultaneously become in phrase. A screen (rigid or semi-rigid mesh material) is used in embodiments of the disclosed technology over portals/tubes in part or in full to add resistance and dissipation of energy there-into.

For purposes of this disclosure, the term "substantially" is defined as "at least 95% of" the term which it modifies.

Any device or aspect of the technology can "comprise" or "consist of" the item it modifies, whether explicitly written as such or otherwise.

Any device or step to a method described in this disclosure can comprise or consist of that which it is a part of, or the parts which make up the device or step. The term "and/or" is inclusive of the items which it joins linguistically and each item by itself.

When the term "or" is used, it creates a group which has within either term being connected by the conjunction as well as both terms being connected by the conjunction.

While the disclosed technology has been disclosed with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described herein above are also contemplated and within the scope of the invention.

What is claimed is:

1. An acoustic metamaterial passive impedance matching device for use in porous/poro-elastic materials to match the impedance load of the porous/poro-elastic materials on an ambient medium, comprising:

a plurality of open tubes attached to at least two outer surfaces of a block of porous/poro-elastic material, and a resistive element in the form of a plurality of perforated screens positioned inside the block of porous/poro-elastic material, wherein the plurality of open tubes and the plurality of open screens generate an acoustic resistance and reactive impedance that matches the complex acoustic impedance load of the block of porous/poro-elastic material on an ambient medium.

2. The acoustic metamaterial passive impedance matching device of claim 1, wherein the plurality of open tubes are spaced evenly around the outer surfaces of the block of porous/poro-elastic material, the plurality of open tubes partially submerged inside the block of porous/poro-elastic material.

3. The acoustic metamaterial passive impedance matching device of claim 2, wherein the plurality of open tubes and the plurality of perforated screens may alternate in arrangement.

4. The acoustic metamaterial passive impedance matching device of claim 3, wherein each of the plurality of open tubes includes a different extent of its part outside the block of porous/poro-elastic material with respect to one another.

5. The acoustic metamaterial passive impedance matching device of claim 4, wherein the number of open tubes and the number of perforated screens are functions of the reactance and resistance of the block of porous/poro-elastic material.

6. The acoustic metamaterial passive impedance matching device of claim 5, wherein the dimension of the open tubes is a function of the reactance of the block of porous/poro-elastic material, the dimensions of the perforated screen dependent on the resistance of the block of porous/poro-elastic material.

7. The acoustic metamaterial passive impedance matching device of claim 6, wherein the plurality of open tubes increase in diameter from a first end of the block of porous/poro-elastic material to a second end of the block of porous/poro-elastic material, such that the plurality of open tubes taper in diameter from the second end to the first end.

8. The acoustic metamaterial passive impedance matching device of claim 6, wherein the plurality of open tubes are uniform in diameter from a first end of the block of porous/poro-elastic material to a second end of the block of porous/poro-elastic material, such that the plurality of open tubes include substantially equal diameters.

9. The acoustic metamaterial passive impedance matching device of claim 6, wherein the plurality of open tubes further comprises a second set of open tubes, each of the open tubes of the second set of open tubes includes open ends to provide an inductive reactance.

10. The acoustic metamaterial passive impedance matching device of claim 5, wherein the dimension of the plurality of open tubes is a function of the reactance of the block of porous/poro-elastic material.

* * * * *